US008695194B2

(12) United States Patent
Kress et al.

(10) Patent No.: US 8,695,194 B2
(45) Date of Patent: Apr. 15, 2014

(54) WEIGHTED RIBBONS AND DUMPLINGS FOR CURTAINS AND OTHER APPLICATIONS, AND METHOD OF MANUFACTURE THEREFOR

(75) Inventors: William D. Kress, Commerce, GA (US); Rodney Loren Smith, Ephrata, PA (US); William Donald Sauerhoefer, Reinholds, PA (US)

(73) Assignee: Kress Designs, LLC, Duluth, GA (US)

( * ) Notice: Subject to any disclaimer, the term of this patent is extended or adjusted under 35 U.S.C. 154(b) by 328 days.

(21) Appl. No.: 13/017,319

(22) Filed: Jan. 31, 2011

(65) Prior Publication Data

US 2011/0117317 A1 May 19, 2011

Related U.S. Application Data

(63) Continuation-in-part of application No. 12/621,643, filed on Nov. 19, 2009.

(51) Int. Cl.
*B23P 17/00* (2006.01)
*A47H 1/00* (2006.01)

(52) U.S. Cl.
USPC ..... 29/414; 29/412; 112/475.06; 160/349.1

(58) Field of Classification Search
USPC ..... 160/348, 349.1, 349.2; 112/153, 112/475.06; 29/412, 414, 413
See application file for complete search history.

(56) References Cited

U.S. PATENT DOCUMENTS

| | | | | |
|---|---|---|---|---|
| 1,828,678 | A | 10/1931 | Peterman et al. | |
| 1,936,198 | A | 11/1933 | Kirsch | |
| 2,245,285 | A | 6/1941 | Loeb | |
| 2,272,656 | A | 2/1942 | Byron | |
| 2,319,292 | A * | 5/1943 | Boggs | 2/96 |
| 2,642,577 | A | 6/1953 | Sherman | |
| 3,107,361 | A | 10/1963 | Glutting, Sr. | |
| 3,224,495 | A | 12/1965 | Truesdale | |
| 3,235,926 | A | 2/1966 | Mates | |
| 3,259,151 | A | 7/1966 | Schmitz | |
| 3,295,264 | A | 1/1967 | Olson | |
| 3,360,015 | A * | 12/1967 | Hughes | 139/389 |
| 3,372,729 | A | 3/1968 | Lindenmayer | |
| 3,439,438 | A | 4/1969 | Tuskos | |
| 3,577,307 | A | 5/1971 | Baier et al. | |
| 3,613,967 | A | 10/1971 | Clement | |

(Continued)

FOREIGN PATENT DOCUMENTS

| | | | |
|---|---|---|---|
| DE | 29705451 | U1 | 7/1997 |
| EP | 1136021 | A2 | 9/2001 |

(Continued)

OTHER PUBLICATIONS

Textol Systems, Inc. Drapery Supplies, Internet Catalog. http://textol-px.rtrk.com/d_items.asp?cat=04 Accessed May 28, 2009; 4 pgs.

(Continued)

*Primary Examiner* — David Bryant
*Assistant Examiner* — Jason L Vaughan
(74) *Attorney, Agent, or Firm* — Thompson Hine LLP

(57) ABSTRACT

Apparatus and methods for the manufacture of weighted ribbons are disclosed, and which weighted ribbons are for use in association with curtains and in other applications.

34 Claims, 10 Drawing Sheets

(56) References Cited

U.S. PATENT DOCUMENTS

| | | | | | |
|---|---|---|---|---|---|
| 3,613,968 | A | | 10/1971 | Kirche | |
| 3,667,659 | A | | 6/1972 | Clement | |
| 3,673,045 | A | | 6/1972 | Baier et al. | |
| 3,684,608 | A | | 8/1972 | Schmitz et al. | |
| 3,738,007 | A | | 6/1973 | Tuskos | |
| 3,802,609 | A | | 4/1974 | Benedetto | |
| 3,818,970 | A | | 6/1974 | Schmitz et al. | |
| 4,142,570 | A | | 3/1979 | Heimberg | |
| 4,167,434 | A | | 9/1979 | Morgan | |
| 4,392,360 | A | | 7/1983 | Gidge et al. | |
| 4,663,915 | A | * | 5/1987 | Van Erden et al. | 53/450 |
| 4,761,945 | A | | 8/1988 | Bünger | |
| 4,770,224 | A | | 9/1988 | Dubbelman | |
| 5,247,781 | A | * | 9/1993 | Runge | 53/412 |
| 6,131,639 | A | * | 10/2000 | McMillen et al. | 160/123 |
| 6,301,754 | B1 | * | 10/2001 | Grunberger et al. | 24/303 |
| 6,336,232 | B1 | | 1/2002 | Toder | |
| 6,761,207 | B1 | | 7/2004 | Homer | |
| 2003/0056333 | A1 | | 3/2003 | Boyle | |

FOREIGN PATENT DOCUMENTS

| | | | |
|---|---|---|---|
| JP | 2000166754 | A | 6/2000 |
| JP | 2002238736 | A | 8/2002 |
| JP | 2003153795 | A | 5/2003 |
| JP | 2003180510 | A | 7/2003 |
| JP | 2003199670 | A | 7/2003 |
| JP | 2006141730 | A | 6/2006 |
| JP | 2006320627 | A | 11/2006 |

OTHER PUBLICATIONS

Drapery Sewing Supplies.com. http://www.draperysewingsupplies.com/Drapery-Weight-p/sw25.htm Accessed May 28, 2009; 1 pg.

Rowley Company LLC, excerpts from product catalog, May 17, 2009; 2 pgs. (See also, online catalog accessible via www.web-rowley.com).

Trademark Office Action, mailed Sep. 22, 2010, in connection with U.S. Appl. No. 85/062,206; 9 pgs.

Trademark Office Action, mailed Jun. 26, 2011, in connection with U.S. Appl. No. 85/062,206; 27 pgs.

Crown Novelty, Specification Sheets variously dated from 1973-1992; 10 pgs.

Digital photographs of products publicly available prior to the earliest effective filing date of Applicants' claimed invention of U.S. Appl. No. 13/017,319; 6 pgs.

* cited by examiner

WEIGHTED RIBBONS AND DUMPLINGS FOR CURTAINS AND OTHER APPLICATIONS, AND METHOD OF MANUFACTURE THEREFOR

PRIORITY CLAIM TO RELATED APPLICATIONS

To the fullest extent permitted by law, the present continuation-in-part patent application claims priority to and the full benefit of non-provisional patent application entitled "Weighted Ribbons and Dumplings for Curtains and Other Applications, and Method of Manufacture Therefor", filed on Nov. 19, 2009, having assigned Ser. No. 12/621,643.

TECHNICAL FIELD

The present disclosure relates, generally, to curtain weights, and, more particularly, to selectable length weighted ribbons, and individual dumplings separable therefrom, together with an associated method of manufacture therefor, and which weighted ribbons and/or dumplings may be used in association with curtains and in other applications.

BACKGROUND OF THE INVENTION

Curtain weighting systems are often used in venues wherein it is important that a curtain hang straight. For example, such weighting systems are most preferably used in situations where the sweeping motion of bi-parting curtains, as they open and close (whether activated manually or by motorized means), must be smooth and pleasant in accord with visual and sensory expectations of, for example, a theater audience.

Curtain weighting systems may further be used in industrial applications, wherein it is important that a curtain be returned quickly and accurately to a closed position. An example of such an application is an industrial loading dock door comprising a vinyl or plasticized curtain of uniform or segmented design, or a screen, wherein forklifts, pallet-moving equipment, or the like, repeatedly traverse the door and curtain arrangement.

Curtain weighting systems are additionally beneficial to ensure that folds and wrinkles may smooth or hang out faster. This is especially true with regard to theater curtains and other curtains used in public facilities, where the fabrics for such curtains have been treated with flame retardants (as required under local fire code for public safety), but where typical flame retardant treatments, especially those used in association with cotton fabrics, render impractical the use of steaming or ironing processes for removal of fold lines and wrinkles. Specifically, steaming or ironing processes can degrade or destroy the flame retardant compound, creating an unsafe condition, and/or can bring the flame retardant to the surface of the fabric, thereby leaving a white residue on the fabric surface and thus ruining the curtain. Of course, steaming or ironing, in general, may also cause the fabric to shrink from its finished size. Accordingly, curtain weighting systems may beneficially contribute to the smooth appearance of such curtains, while avoiding the consequences of adverse steaming and ironing processes.

Curtain weighting systems may be applied to curtains, either in horizontally or vertically disposed arrangement, most often within a hem, depending upon the user's application. Individual weights are sometimes placed within a pocket formed adjacent a lower margin of the curtain, or near or within a hem, or are pinned to an appropriate area near the curtain margin. Such prior art curtain weighting systems are of varying designs, most typically of a corded or chained arrangement. Exemplars of such designs may be seen with reference to United States Patent Application Publication Number US 2003/0056333 to Boyle, U.S. Pat. Nos. 3,577,307 and 3,673,045 to Baier et al., and U.S. Pat. No. 3,259,151 to Schmitz. Some systems comprise weighted pins, as may be seen with reference to U.S. Pat. No. 1,936,198 to Kirsch, and U.S. Pat. No. 1,828,678 to Peterman et al.

Other systems, such as may be seen with reference to FIG. 2 herein (Crown Novelty Works Corp., Holly Springs, Miss., USA), comprise a plurality of individual lead weights, sewn or otherwise glued to a strip of backing material, the backing material typically being of cotton. This strip bearing the plurality of lead weights is then surrounded by facing strips, again typically of cotton material, and closed by sewing along the top and bottom lengths of the strips (as shown in FIG. 2).

It will be immediately recognized by one of ordinary skill in the art that the above-referenced systems typically utilize lead weights due to their ease of puncturing during sewing processes. However, it is well known that lead is a hazardous material, and may cause or contribute to chronic conditions such as kidney damage, nervous system damage, hypertension, and reproductive system damage. Furthermore, when lead is heated to high temperatures, such as might be experienced during a fire, toxic decomposition products are released, and explosion dangers are possible if placed in contact with water. For these reasons, lead is not a preferred weighting material for use in private or public applications, and it has thus become increasingly difficult to secure domestic supplies of lead for fabrication of the required weights.

It will also be recognized by one of ordinary skill in the art that such prior art weighting systems are often less than optimally conducive to mechanical division from strip form into separate weight units, or into selected lengths. This is because cutting between the weights leaves, at best, an unfinished fabric edge that may unravel without end. At worst, cutting the strip between weights leaves open the individual segment at one or both ends, thus exposing the leaden weight therewithin. Most often, both circumstances occur.

Further disadvantageously, the components of such prior art weighting systems are sewn or stitched together according to well-known, single-line seams. This manner of construction may further contribute to the unraveling of fabric edges, together with exposure and/or loss of the internal leaden weights. Yet additionally, such prior art systems are often not flame retardant and are not typically subject to flame testing.

Thus, it is clear that there is an unmet need for a weight system, with associated methods of fabrication and use of such a weight system, that avoids the use of leaden weights; that allows for convenient, safe, and secure separation of a larger "roll stock" of weighted ribbon into smaller selected lengths of multi-weight ribbon, or into individual weight segments; that provides for securely fused edges or seals, even upon separation of a larger "roll stock" of weighted ribbon into smaller selected lengths of multi-weight ribbon, or into individual weight segments; that avoids the use of sewn or stitched seams as a structural component of the weighted ribbon; that is pretreated to provide flame retardant characteristics or is inherently flame retardant; and that is convenient and safe to fabricate and to use.

BRIEF SUMMARY OF THE INVENTION

Briefly described, in a preferred embodiment, the system and method of the present invention overcome the above-mentioned disadvantages and meet the recognized need for such a system and method by providing a fire retardant, polymer strip or "ribbon," preferably of woven, fusible, polyester fabric, which is v-folded to form a closed-end along the longitudinal length of the ribbon, and to thus provide a trough-like structure for the receipt of uniformly dimensioned weights therewithin. The weights preferably are formed of galvanized or stainless steel (and are lead-free), each of which are inserted into the ribbon in a spaced array, and preferably at specific intervals. The polymer ribbon is then preferably ultrasonically or heat sealed (or fused) at least between each weight to form a plurality of individual weight segments along the ribbon's length, each individual weight segment otherwise called a "dumpling." Yet additionally, a continuous or a discontinuous longitudinal seal is formed through the length of the entire ribbon (via ultrasonic or heat sealing), preferably just below the abutting top edges of the trough-like or v-folded ribbon. As such, each individual weight is maintained, captured or otherwise encapsulated within side seals, a top seal, and a closed-end.

More specifically, and with regard to the side seals, ultrasonic or heat sealing technology is used to form double seals between each weight, such that individual weight dumplings, or selected lengths of multi-weight ribbon, can be separated from a larger "roll stock" of such weighted ribbon by cutting through an unsealed section defined by, and disposed between, any of the double seals. Alternatively, ultrasonic or heat sealing technology is used to form a single fused section (i.e., a broad-single-seal) of substantial width in its lateral dimension between each weight, such that the weighted ribbon may be cut within the broad-single-seal to similarly provide individual weight dumplings, or selected lengths of multi-weight ribbon, from a larger "roll stock" of such weighted ribbon.

The longitudinal seal may be continuous, extending uninterrupted through the entire length of the ribbon, and thus intersecting either the double seals or the broad-single-seals of either embodiment. Alternatively, the longitudinal seal may be discontinuous, extending through the length of the entire ribbon as a series of short seals formed at regular intervals, such that at least one short seal is formed between either the double seals or the broad-single-seals flanking an individual weight seated within the ribbon trough of either embodiment. However, the short seals neither intersect the double seals or the broad-single-seals, nor are interposed or formed within the unsealed sections disposed between any of the double seals, nor within the single fused sections of any of the broad-single-seals. Instead, each such short seal of the discontinuous longitudinal seal spans a length that is shorter than or equal to the width of an individual weight seated within the ribbon trough, and is most preferably formed or positioned equidistant from the inner lateral edges of either the double seals or the broad-single-seals of each individual weight segment within the fully-sealed weighted ribbon. Accordingly, in either the continuous or the discontinuous longitudinal seal embodiments, each individual weight is maintained, captured or otherwise encapsulated within side seals, a top seal, and a closed-end. The decision to use either a continuous or a discontinuous longitudinal seal may be based upon the particular application in which the weighted ribbon is to be used, or upon the physical characteristics (e.g., thickness, weight, denier, etc.) of the particular fabric of the ribbon, or upon the particular fabric or material of the curtain in which the weighted ribbon is to be used, or further upon a preferred manufacturing process. For example, the physical characteristics (e.g., thickness, weight, denier, etc.) of the particular fabric of the ribbon will affect the relative flexibilities offered through either a continuous or a discontinuous longitudinal seal embodiment, and thus provide for relatively greater, lesser or even equivalent flexibilities between either embodiment.

In either of the double-seal or broad-single-seal embodiments, wherein either a continuous or a discontinuous longitudinal seal may be used, individual weight dumplings and/or selected lengths of multi-weight ribbon may be cut from a larger "roll stock" of such weighted ribbon without causing dysfunctional fraying and/or unraveling of the woven ribbon material proximate the cut(s), and thus exposure of the weight(s) within the ribbon trough. In sum, the double-seals and the broad-single-seals provide a digitally-defined point, region or section for transverse division or cutting of the weighted ribbon into discrete lengths (or "loose" dumplings), and thus prevent loss of any weight(s) adjacent to such a transverse cut or division of the weighted ribbon. Yet additionally, the double-seals and the broad-single-seals provide a fray-reduction element or fray stopping point when the weighted ribbon is cut to provide discrete lengths (or "loose" dumplings).

The preferred weight is relatively thin and flat, and of uniform width and height, in order that the finished ribbon and/or dumpling products lie flat and unobtrusively against the curtain or fabric member with which it is to be used. In the preferred embodiment, the unit ribbon weight, or, alternatively, the unit dumpling weight, is selected by providing a relatively thicker or thinner weight, the width and height dimensions being otherwise preferably unaffected.

In use, a preselected length or precut section of weighted ribbon, or an individual dumpling, is sewn or otherwise affixed to a curtain or other fabric material member in a location consistent with the intended use. This location may be within a formed hem, in a seam, at a fabric margin, or otherwise at the user's discretion.

In addition or as an alternative to sewing, the manner of affixing the weighted ribbon or dumpling to a curtain or other fabric member may also be via cooperating hook and loop fasteners, cooperating mechanical snap means, cooperating button and hole means, adhesives, adhesive tapes, or the like.

Thus, and uniquely advantageous to the present invention, the weight system described herein avoids the use of leaden weights; allows for convenient, safe, and secure separation of a larger "roll stock" of weighted ribbon into smaller selected lengths of multi-weight ribbon, or into individual weight segments (i.e., individual weight dumplings); provides for securely fused edges or seals, even upon cutting or separation of a larger "roll stock" of weighted ribbon into smaller selected lengths of multi-weight ribbon, or into individual weight dumplings; avoids the use of sewn or stitched seams as a structural component of the weighted ribbon; is pretreated to provide flame retardant characteristics or, alternatively, is inherently flame retardant; and is convenient and safe to fabricate and to use.

Accordingly, one feature and advantage of the system and method of the present invention is the ability to avoid the use of leaden weights.

Another feature and advantage of the system and method of the present invention is to allow for convenient, safe, and secure cutting or separation of a larger "roll stock" of weighted ribbon into smaller selected lengths of multi-weight ribbon, or into individual weight segments (i.e., dumplings).

Another and further feature and advantage of the system and method of the present invention is to provide for securely fused edges or seals, even upon cutting or separation of a larger "roll stock" of weighted ribbon into smaller selected lengths of multi-weight ribbon, or into individual weight dumplings.

Another and further feature and advantage of the system and method of the present invention is the use of a continuous or a discontinuous longitudinal seal, either of which provides a top seal that, in conjunction with the side seals and closed-end, fully maintains, captures or otherwise encapsulates each individual weight within the weighted ribbon, and in any smaller selected lengths of multi-weight ribbon, and in any individual weight segments, cut or separated from a larger "roll stock" of weighted ribbon.

Another and further feature and advantage of the system and method of the present invention is the ability to select between either a continuous or a discontinuous longitudinal seal to impart the fully-sealed weighted ribbon with relatively greater, lesser or even equivalent flexibilities between either embodiment, depending upon the physical characteristics (e.g., thickness, weight, denier, etc.) of the particular fabric of the ribbon.

Another and still further feature and advantage of the system and method of the present invention is to avoid the use of sewn or stitched seams as a structural component of the weighted ribbon.

Another feature and yet still further advantage of the system and method of the present invention is to provide flame retardant characteristics.

Another feature and further advantage of the system and method of the present invention is to provide a system incorporating a preferred weight that is relatively thin and flat, and of uniform width and height, in order that the finished ribbon and/or dumpling products lie flat and unobtrusively against the curtain or fabric member with which it is to be used.

Another feature and further advantage of the system and method of the present invention is that the unit ribbon weight, or, alternatively, the unit dumpling weight, may be selected by providing a relatively thicker or thinner weight, the width and height dimensions being otherwise preferably unaffected.

Another feature and further advantage of the system and method of the present invention is to provide a weighting system that is convenient and safe to fabricate and to use.

These and other features and advantages of the system and method of the present invention will become apparent to those ordinarily skilled in the art after reading the following Detailed Description of the Invention and Claims in light of the accompanying drawing Figures.

BRIEF DESCRIPTION OF THE DRAWINGS

Accordingly, the system and method of the present invention will be understood best through consideration of, and with reference to, the following drawings, viewed in conjunction with the Detailed Description of the Invention referring thereto, in which like reference numbers throughout the various drawings designate like structure, and in which.

Figure 1:
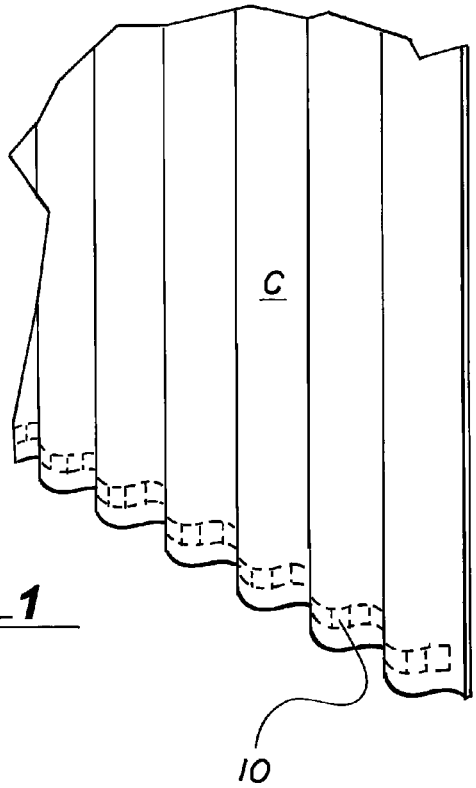
FIG. 1 is an exemplary curtain carrying a section of weighted ribbon according to the present invention.
Figure 6:
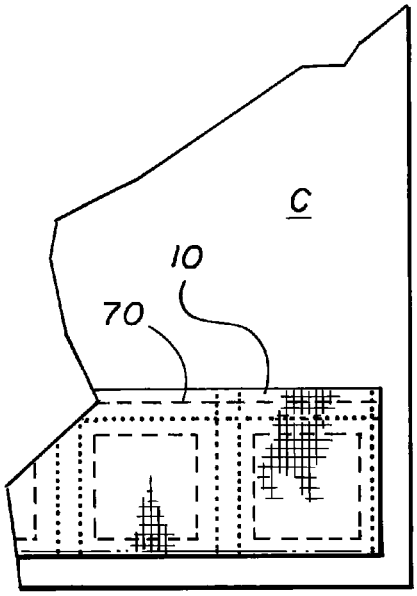
FIG. 6 is a sectional view of a curtain member carrying a horizontally disposed section of weighted ribbon in accordance with the present invention.
Figure 7:
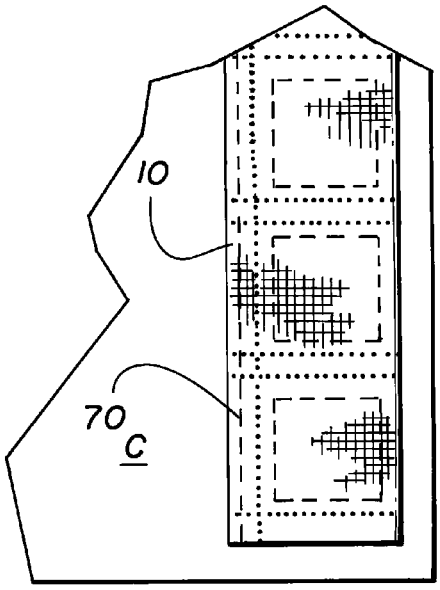
FIG. 7 is a sectional view of a curtain member carrying a vertically disposed section of weighted ribbon in accordance with the present invention.
Figure 2:
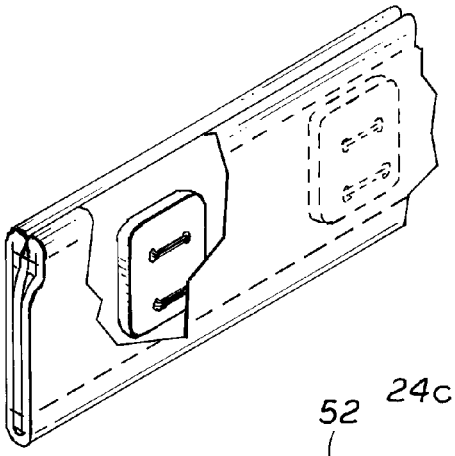
Fig. 2 PRIOR ART
FIG. 2 depicts a prior art curtain weight strip construction, and shows a partial sectional view thereof (Crown Novelty Works Corp., Holly Springs, Miss., USA)

It is to be noted that the drawing Figures presented are intended solely for the purpose of illustration and that they are, therefore, neither desired nor intended to limit the claimed invention to any or all of the exact details of construction shown, except insofar as they may be deemed essential to the claimed invention.

DETAILED DESCRIPTION OF THE INVENTION

In describing preferred and alternate embodiments of the system and method of the present disclosure illustrated in the drawing Figures, specific terminology is employed for the sake of clarity. The claimed invention, however, is not intended to be limited to the specific terminology so selected, and it is to be understood that each specific element includes all technical equivalents that operate in a similar manner to accomplish a similar purpose.

In that form of the preferred embodiment of the system and method of the present invention chosen for purposes of illustration, FIG. 1 shows curtain C carrying a section of weighted ribbon 10 according to the present invention.

Figure 3:
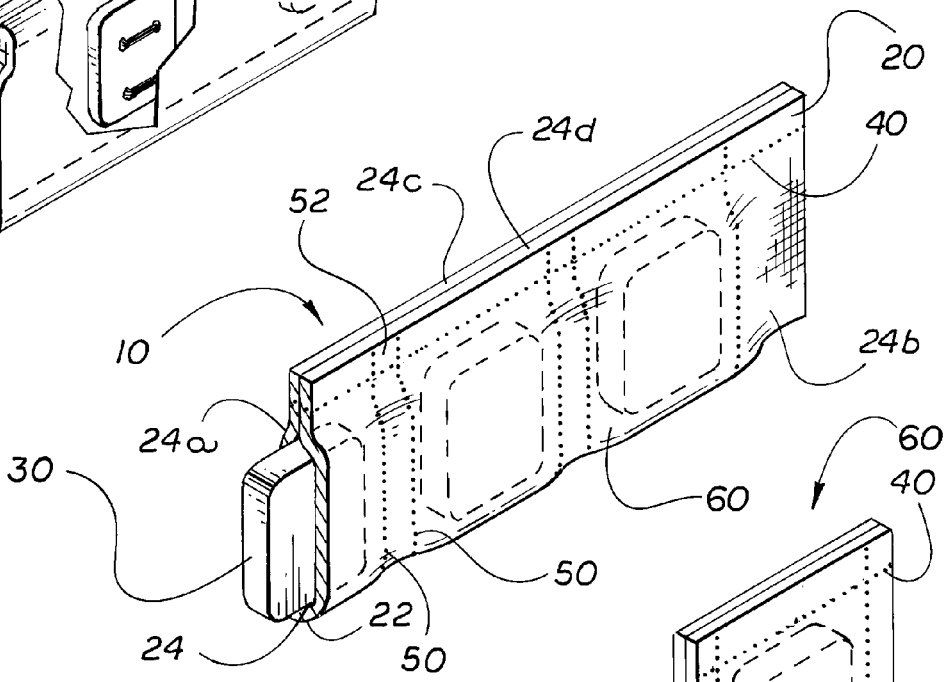
FIG. 3 depicts a portion of a weighted ribbon according to the present invention, and shows a partial sectional view thereof.

As best seen with reference to FIG. 3, weighted ribbon 10 provides a fire retardant, polymer strip or "ribbon", preferably of an ultrasonically-sealable and/or heat-sealable (i.e., fusible), woven polyester fabric, such as that available through Bally Ribbon Mills (Bally, Pa.) and denominated under Bally Ribbon Mills Pattern No. 500803000NF77, 5008-3" Natural "30% GLO TARD Flm. Trt." Poly Tape. Of course, ribbon may be of any other suitable heat-sealable and/or ultrasonically-sealable woven fabrics, non-woven fabrics, mesh fabrics (either woven or non-woven), films, and/or woven/non-woven fabric and film composites (including mesh fabric and film composites), such as those formed from, but not limited to, polypropylene, polyethylene, and polyolefin. Additionally, and although GLOTARD Flame Treatment, and specifically GLOTARD NY-22MG, is the preferred flame retardant with which ribbon 20 is to be pretreated, other flame retardants may be used, and preferably those that meet the National Fire Protection Association NFPA 701 Small and Large Scale Tests.

Ribbon 20 is preferably v-folded to provide a closed-end 22 along the length of ribbon 20, and to thus form a trough 24 for the receipt of uniformly dimensioned weights 30 therewithin. Trough 24 preferably comprises sides 24*a* and 24*b*, and top edges 24*c*, 24*d*. Weights 30 preferably are formed of galvanized or stainless steel or other suitable non-staining metals (and are lead-free), each of which are positioned within trough 24 of v-folded ribbon 20, and preferably at specific intervals or any other selected spaced array.

With continued reference to FIG. 3, polymer ribbon 20 is preferably ultrasonically or heat sealed (fused) to form a continuous longitudinal seal 40, proximate the abutting top edges 24*c*, 24*d* of trough 24, and to further form transverse double seals 50, to thus provide a plurality of individual weight segments 60 along the length of ribbon 20, each individual weight segment 60 otherwise called a "dumpling." Transverse double seals 50 preferably extend from closed-end 22, through continuous longitudinal seal 40, and to top edges 24*c*, 24*d* of trough 24. As such, each individual weight 30 within weighted ribbon 10 is maintained, captured or otherwise encapsulated within respective "side" seals 50, a "top" longitudinal seal 40, and a "bottom" closed-end 22.

Figure 4:
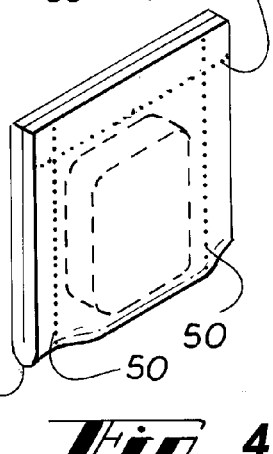
FIG. 4 depicts an individual weight dumpling according to the present invention.
Figure 14:
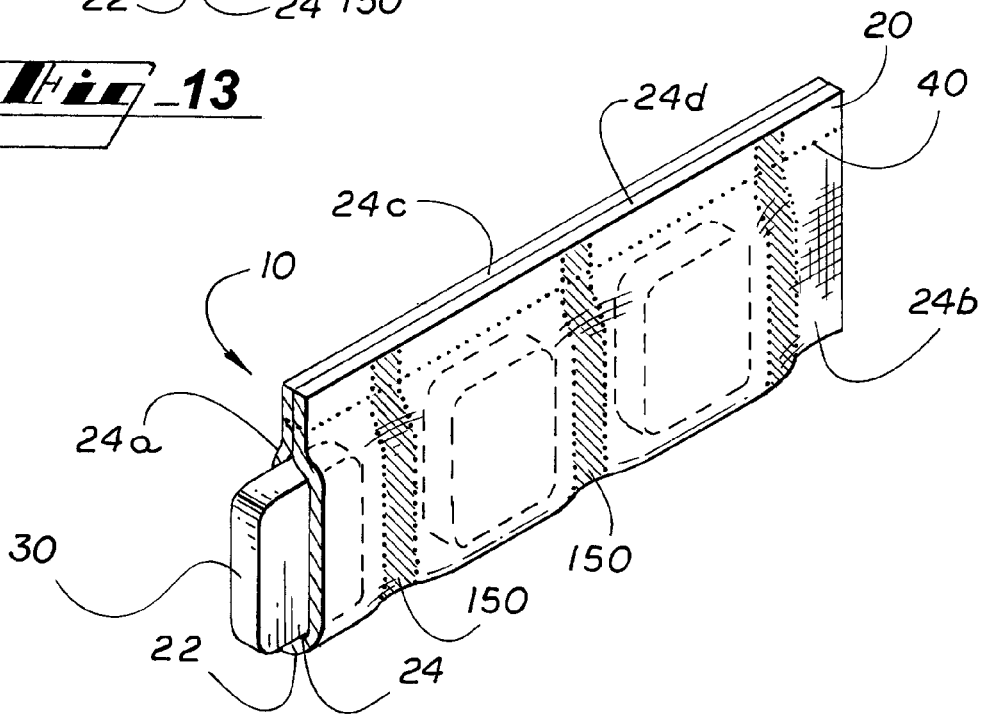
FIG. 14 depicts a portion of a weighted ribbon according to an alternate embodiment of the present invention, and shows a partial sectional view thereof.
Figure 15:
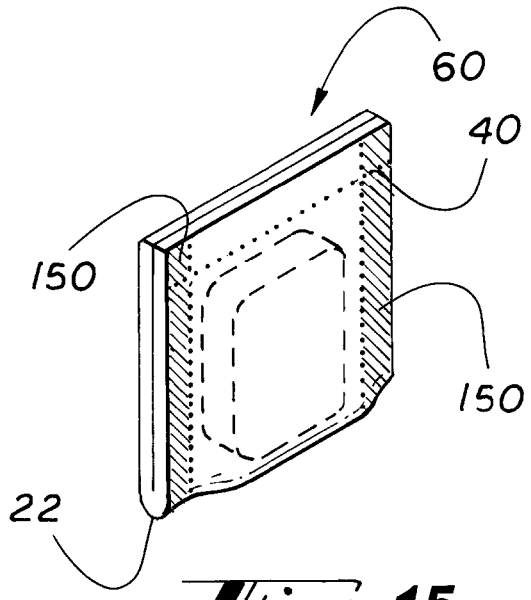
FIG. 15 depicts an individual weight dumpling according to an alternate embodiment of the present invention.
Figure 16:
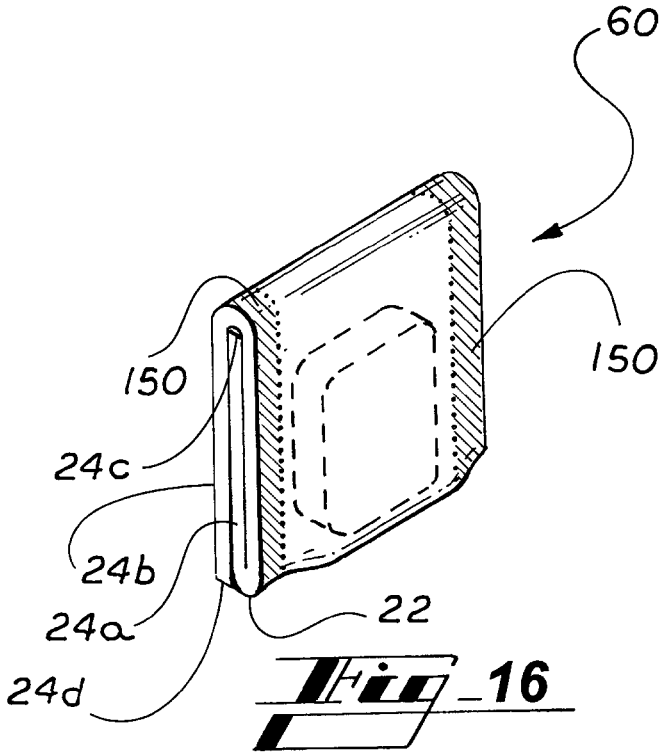
FIG. 16 depicts an individual weight dumpling according to an alternate embodiment of the present invention.
Figure 17:
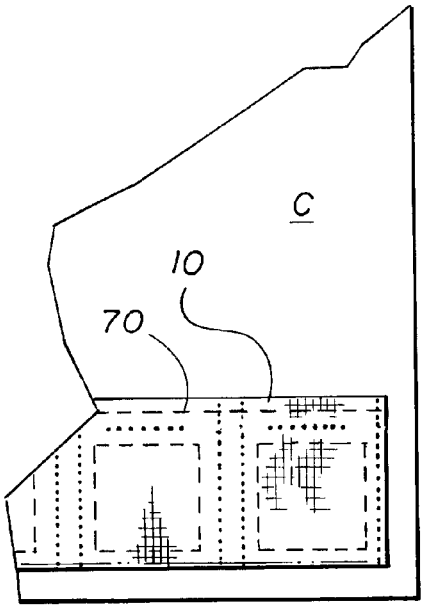
FIG. 17 is a sectional view of a curtain member carrying a horizontally disposed section of weighted ribbon in accordance with an alternate embodiment of the present invention.
Figure 18:
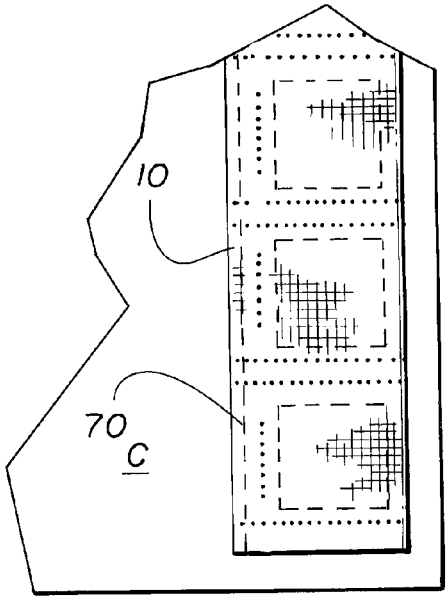
FIG. 18 is a sectional view of a curtain member carrying a vertically disposed section of weighted ribbon in accordance with an alternate embodiment of the present invention.
Figure 19:
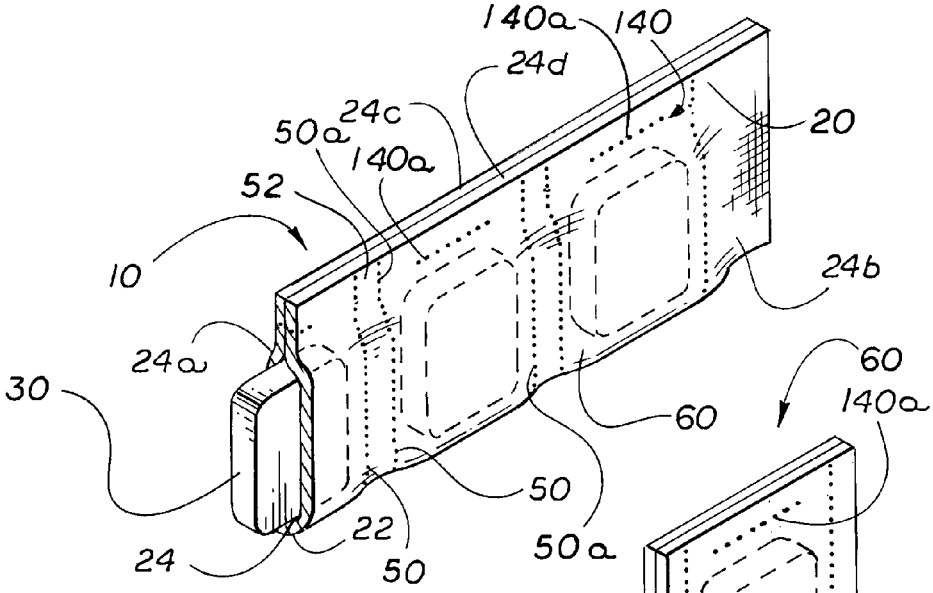
FIG. 19 depicts a portion of a weighted ribbon according to an alternate embodiment of the present invention, and shows a partial sectional view thereof.
Figure 20:
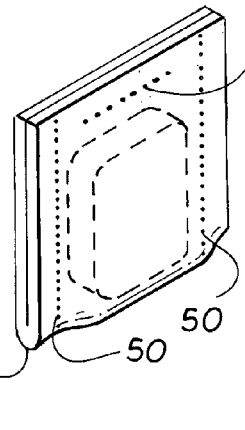
FIG. 20 depicts an individual weight dumpling according to an alternate embodiment of the present invention.
Figure 21:
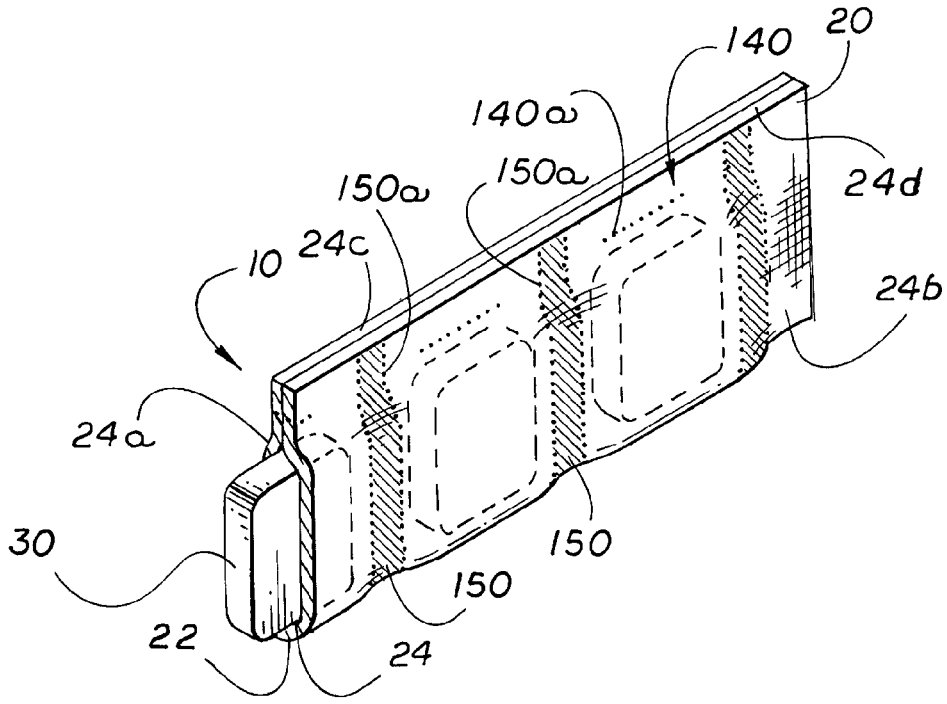
FIG. 21 depicts a portion of a weighted ribbon according to an alternate embodiment of the present invention, and shows a partial sectional view thereof.
Figure 22:
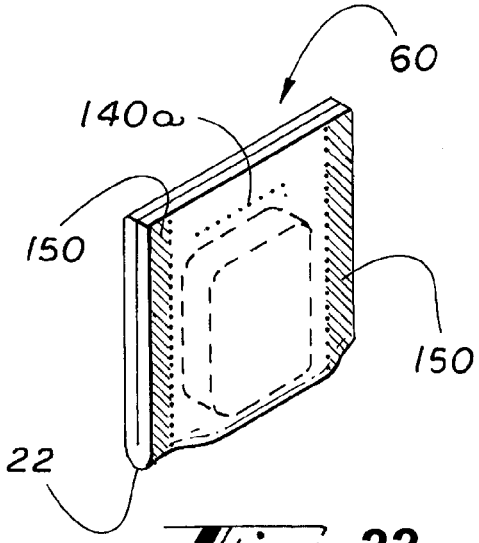
FIG. 22 depicts an individual weight dumpling according to an alternate embodiment of the present invention.
Figure 23:
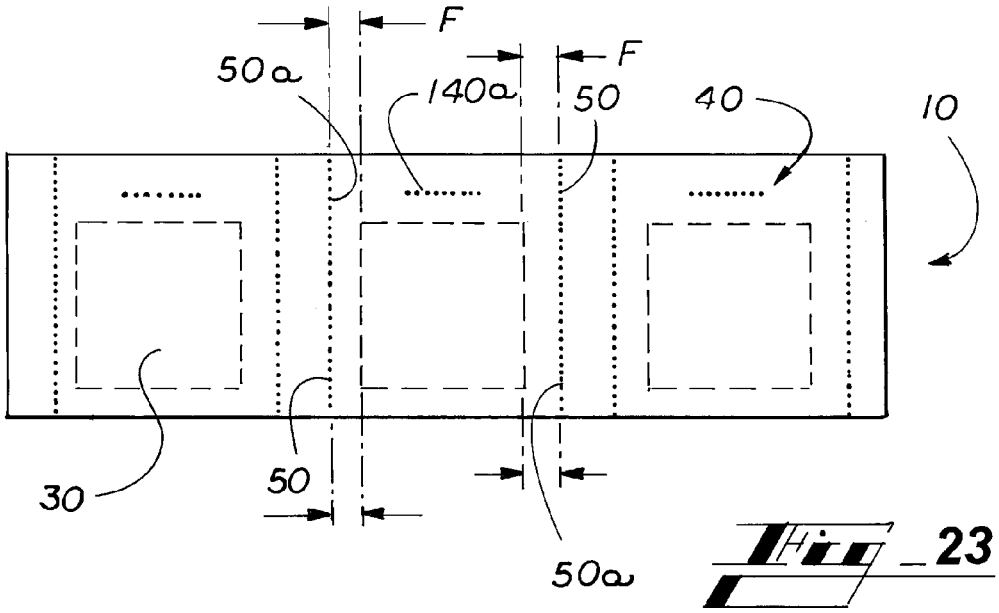
FIG. 23 depicts a portion of a weighted ribbon according to an alternate embodiment of the present invention.
Figure 24:
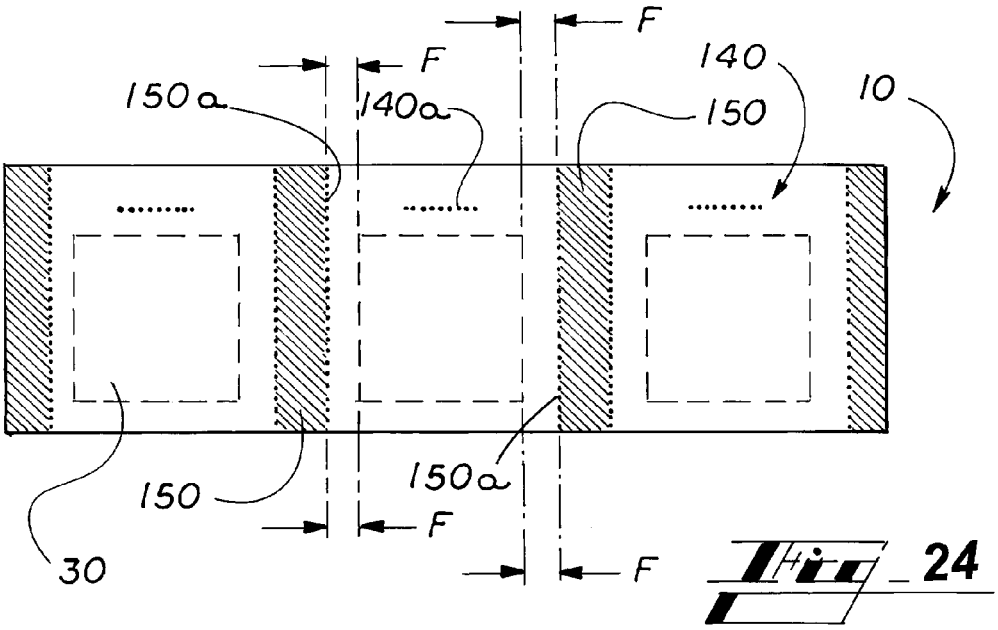
FIG. 24 depicts a portion of a weighted ribbon according to an alternate embodiment of the present invention; and, FIG. 25 is a flow chart depicting the form and function of a machine assembly that may be used to implement the methods of manufacture of the several embodiments of the weighted ribbon of the present invention.

Specifically, between each weight 30 are formed transverse double seals 50, such that "loose" individual weight dumplings (see, FIG. 4), or desired sections or lengths of multi-weight ribbon 10, can be separated by cutting through the unsealed sections 52 between any selected double seals 50. Alternatively, and with reference to FIG. 14, ultrasonic or heat sealing technology is used to form a transverse single seal or fused section 150 (i.e., a broad-single-seal), of substantial width in its lateral dimension, between the individual weight segments 60, such that weighted ribbon 10 may be cut within the broad-single-seal 150 to similarly provide "loose" individual weight dumplings 60 (see, FIG. 15), or selected sections or lengths of multi-weight ribbon 10. Broad-single-seals 150 also preferably extend from closed-end 22, through continuous longitudinal seal 40, and to top edges 24*c*, 24*d* of trough 24. As such, each individual weight 30 within weighted ribbon 10 is maintained, captured or otherwise encapsulated within respective "side" seals 150, a "top" longitudinal seal 40, and a "bottom" closed-end 22.

As described herein, longitudinal seal 40 is a continuous seal that extends uninterrupted through the entire length of ribbon 20, and thus intersects either double seals 50 or broad-single-seals 150 of the ribbon 10 embodiments depicted in, for example, FIGS. 3, 4, 14, 15. Alternatively, and as depicted in FIGS. 17-24, ribbon 20 is provided with a discontinuous longitudinal seal 140, proximate the abutting top edges 24*c*, 24*d* of trough 24. Specifically, discontinuous longitudinal seal 140 extends through the length of the entire ribbon 20 as a series of short seals 140*a* formed at regular intervals, such that at least one short seal 140*a* is formed between either double seals (see, FIG. 19) or broad-single-seals 150 (see, FIG. 21) flanking an individual weight 30 seated within trough 24 of ribbon 20. However, short seals 140*a* neither intersect double seals 50 or broad-single-seals 150, nor are interposed or formed within unsealed sections 52 disposed between any of double seals 50, nor within the single fused sections of any of broad-single-seals 150. Instead, each such short seal 140*a* of discontinuous longitudinal seal 140 spans a length that is shorter than or equal to the width of an individual weight 30 seated within trough 24 of ribbon 20, and is most preferably formed or positioned equidistant from inner lateral edges 50*a* of double seals 50 (or inner lateral edges 150*a* of broad-single-seals 150) of each individual weight segment 60 within the fully-sealed weighted ribbon 10. Accordingly, in those embodiments of weighted ribbon 10 in which discontinuous longitudinal seal 140 is used, each individual weight 30 within weighted ribbon 10 is maintained, captured or otherwise encapsulated within respective "side" seals 50 (or 150), a "top" short seal 140*a* (of discontinuous longitudinal seal 140), and a "bottom" closed-end 22 (see, e.g., FIGS. 17-22).

In either of the double-seal 50 or broad-single-seal 150 embodiments, wherein either continuous longitudinal seal 40 or discontinuous longitudinal seal 140 may be used, a larger "roll stock" of weighted ribbon 10 (see, e.g., FIGS. 3, 14, 19, 21) may be cut within unsealed sections 52 between any selected double seals 50, or within any broad-single-seals 150, to provide loose individual weight dumplings 60 (see, FIGS. 4, 15, 20, 22) and/or selected lengths of multi-weight ribbon 10, without causing endless fraying and/or unraveling of the woven ribbon 20 proximate the cut(s), and thus exposure and/or loss of weight(s) 30 within trough 24. Specifically, double-seals 50 and broad-single-seals 150 provide a digitally-defined point, region or section for transverse division or cutting of weighted ribbon 10 into discrete lengths (or "loose" dumplings), and thus prevent loss of any weight(s) 30 adjacent to such a transverse cut or division of weighted ribbon 10. Yet additionally, and most fundamentally, seals 50, 150 provide a fray-reduction element or fray stopping point when ribbon 10 is cut to provide discrete lengths (or "loose" dumplings).

The decision to use either continuous longitudinal seal 40 or discontinuous longitudinal seal 140 may be based upon the particular application in which weighted ribbon 10 is to be used, or upon the physical characteristics (e.g., thickness, weight, denier, etc.) of the particular fabric of ribbon 20, or upon the particular fabric or material of the curtain in which weighted ribbon 10 is to be used, or further upon a preferred manufacturing process. Specifically, inasmuch as continuous longitudinal seal 40 intersects with either double seals 50 or broad-single-seals 150 of either embodiment, these areas or points of intersecting seals may provide weighted ribbon 10 with desirably less flexibility in the fabric areas proximate these intersecting seals, than is provided through use of discontinuous longitudinal seal 140 (which, to reiterate, does not intersect with either double seals 50 or broad-single-seals 150). Accordingly, weighted ribbon 10 having such continuous longitudinal seal 40 may be used in those applications where less flexibility is desired in the fully-sealed weighted ribbon 10, and particularly between each individual weight segment 60 thereof (for example, and without limitation, where subtler curves or folds in the bottom hem of the curtain are desired). In comparison, and inasmuch as discontinuous longitudinal seal 140 does not intersect with either double seals 50 or broad-single-seals 150, discontinuous longitudinal seal 140 may provide for desirably greater flexibility at the unsealed fabric areas F subsisting between or proximate short seals 140*a* of discontinuous longitudinal seal 140 and inner lateral edges 50*a* of double seals 50 (or inner lateral edges 150*a* of broad-single-seals 150) of fully-sealed weighted ribbon 10 (see, FIGS. 23, 24). Accordingly, weighted ribbon 10 having discontinuous longitudinal seal 140 may be used in those applications where greater flexibility is desired in the fully-sealed weighted ribbon 10, and particularly between each individual weight segment 60 thereof (for example, and without limitation, where more pronounced curves or folds in the bottom hem of the curtain are desired).

Of course, the physical characteristics (e.g., thickness, weight, denier, etc.) of the particular fabric of ribbon 20 will affect the relative flexibilities offered through either a continuous (40) or a discontinuous (140) longitudinal seal embodiment, and thus provide for relatively greater, lesser or even equivalent flexibilities between either embodiment. As such, it is contemplated herein that a fully-sealed weighted ribbon 10 having continuous longitudinal seal 40 may have greater flexibility, and particularly between each weight segment 60 thereof, than a fully-sealed weighted ribbon 10 having discontinuous longitudinal seal 140, or a flexibility equivalent thereto, depending upon the particular ribbon fabrics employed in either embodiment. It is further contemplated herein that unsealed sections 52 disposed between double seals 50 would provide fully-sealed weighted ribbon 10 with a flexibility, and particularly between each individual weight segment 60 thereof, that would be in addition to the flexibility provided through either a continuous (40) or a discontinuous (140) longitudinal seal embodiment, depending upon the particular ribbon fabrics employed in either such embodiment. Similarly, it is yet further contemplated herein that broad-single-seals 150 would provide fully-sealed weighted ribbon 10 with a flexibility, and particularly between each individual weight segment 60 thereof, that would be in addition to the flexibility provided through either a continuous (40) or a discontinuous (140) longitudinal seal embodiment, depending upon the particular ribbon fabrics employed in either such embodiment.

Figure 5:
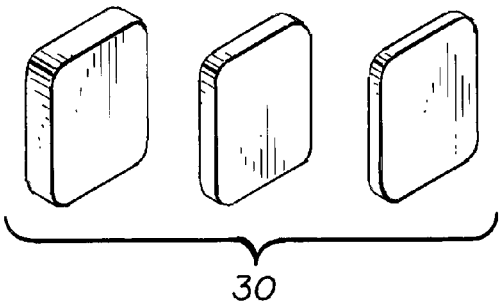
FIG. 5 depicts the structure of individual weights for use in association with the present invention, and further depicts varying thicknesses thereof for selected use.

With reference now to FIG. 5, the preferred weight 30 is substantially square in shape, relatively thin and flat, and of uniform width and height, in order that the finished ribbon 10 and/or dumpling 60 products lie flat and unobtrusively against the curtain C or fabric member with which it is to be used. In the preferred embodiment, the unit ribbon weight, or, alternatively, the unit dumpling weight, is selected by providing a relatively thicker or thinner weight, as best seen in comparison of the several weights 30 depicted within FIG. 5, the width and height dimensions being otherwise preferably unaffected.

As a non-limiting exemplary disclosure, weights 30 are approximately 1.05 inches wide x1.10 inches high, and more preferably approximately 1.00 inch wide x1.00 inch high, the only variable being the thickness thereof, as best seen with continuing reference to FIG. 5. A preferred thickness range for typical curtain applications is between approximately 0.070-0.110 inches. Within this thickness range, weights 30 will fall between approximately 10-28 grams each for galvanized steel materials.

It will be apparent to one of ordinary skill in the art that further adjustment of weight per unit length of weighted ribbon 10 may also be made by increasing or decreasing the spacing between weights 30, so that a greater or fewer number of weights 30 of preselected thickness, are thusly disposed within weighted ribbon 10 per unit length. Yet additionally, the unit weight may be further affected by alternating, or even varying, thicknesses of weights 30 along the length of weighted ribbon 10.

In use, a preselected or precut section of weighted ribbon 10, or an individual dumpling 60, is sewn, as via thread 70, or otherwise affixed to curtain C or other fabric material member in a location and direction consistent with the intended use. As best seen with reference to FIGS. 6-10, 17, 18, this location may be within a formed hem H, in a seam, at a fabric margin, or otherwise at the user's discretion.

Figure 8:
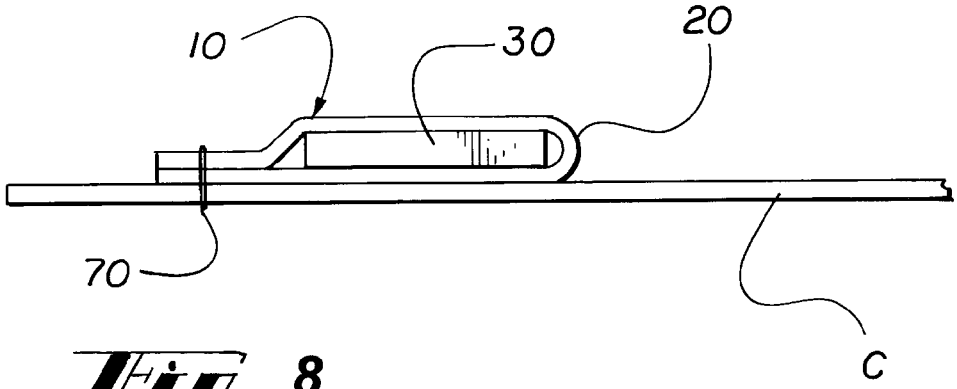
FIG. 8 is a sectional view of a curtain member, viewed from an edge thereof, showing a section of weighted ribbon of the present invention affixed in simple form to the curtain member.
Figure 9:
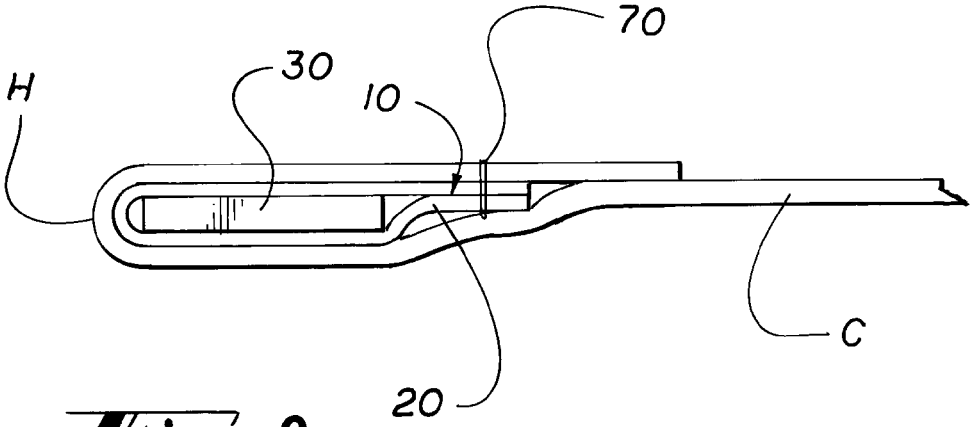
FIG. 9 is a sectional view of a curtain member, viewed from an edge thereof, showing a section of weighted ribbon of the present invention affixed within a hem of the curtain member.
Figure 10:
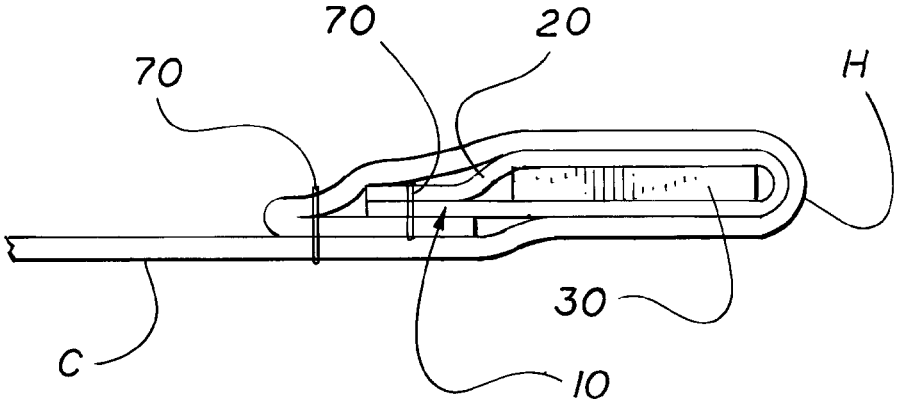
FIG. 10 is a sectional view of a curtain member, viewed from an edge thereof, showing a section of weighted ribbon of the present invention affixed within a doubled hem of the curtain member.
Figures 11, 12:
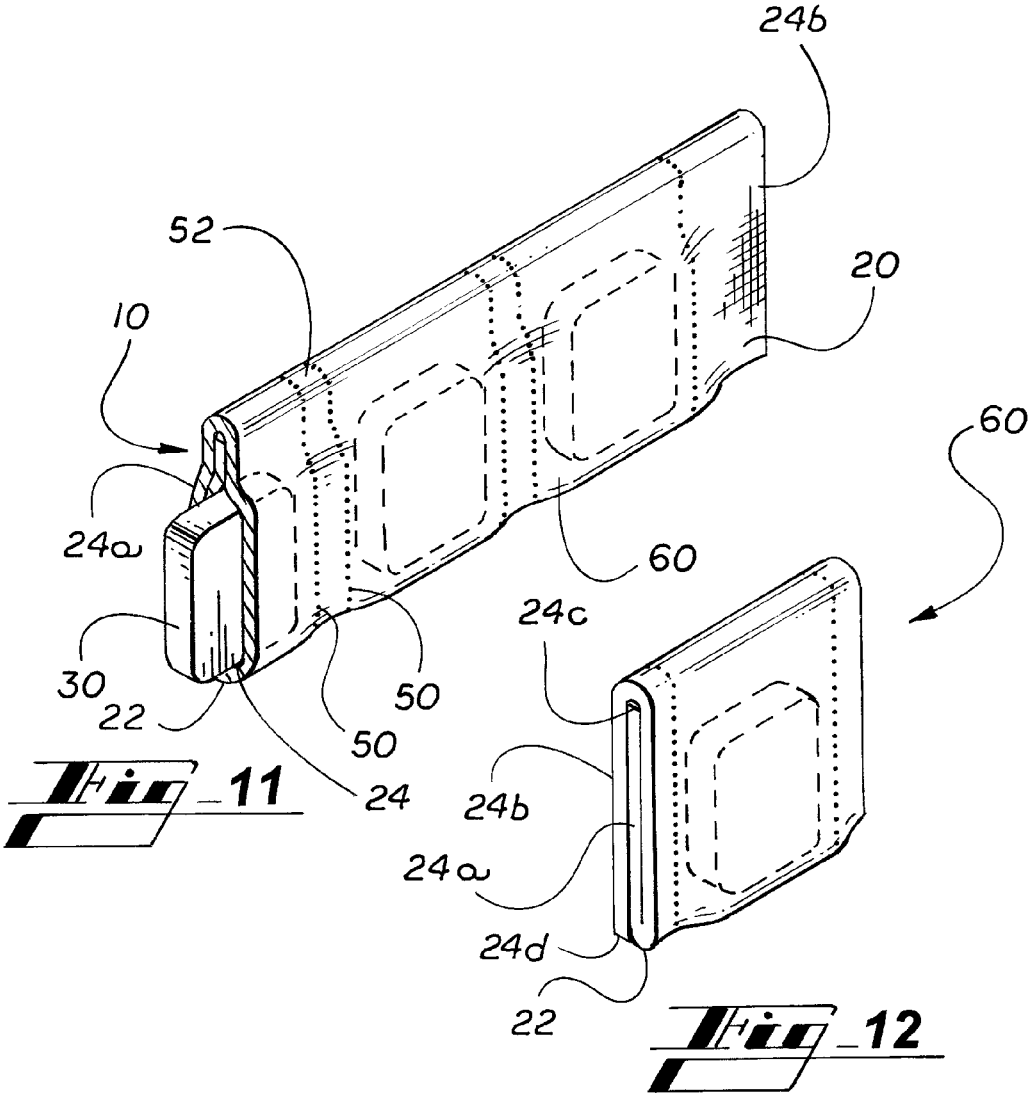
FIG. 11 depicts a portion of a weighted ribbon according to an alternate embodiment of the present invention, and shows a partial sectional view thereof.
FIG. 12 depicts an individual weight dumpling according to an alternate embodiment of the present invention.

For example, depicted in FIG. 8 is a section of curtain C, viewed from an edge thereof, showing a section of weighted ribbon 10 affixed in simple form to the curtain member. Similarly, FIG. 9 depicts a section of curtain C, viewed from an edge thereof, showing a section of weighted ribbon 10 affixed within a hem H of the curtain member. Still further, FIG. 10 shows a section of curtain C, viewed from an edge thereof, showing a section of weighted ribbon 10 affixed within a doubled hem H of the curtain member.

In addition or as an alternative to sewing, the manner of affixing the weighted ribbon 10 or dumpling 60 to the curtain or other fabric member may also be via cooperating hook and loop fasteners, cooperating mechanical snap means, cooperating button and hole means, adhesives, adhesive tapes, or the like.

Thus, and uniquely advantageous to the present invention, the weight system described herein avoids the use of leaden weights; allows for convenient, safe, and secure separation of a larger "roll stock" of weighted ribbon 10 into smaller selected lengths of multi-weight ribbon 10, or into individual weight dumplings 60; provides for securely fused edges or seals, even upon cutting or separation of a larger "roll stock" of weighted ribbon 10 into smaller selected lengths of multi-weight ribbon 10, or into individual weight dumplings 60; avoids the use of sewn or stitched seams as a structural component of weighted ribbon 10; is pretreated to provide flame retardant characteristics or, alternatively, is inherently flame retardant; and is convenient and safe to fabricate and to use.

Figure 13:
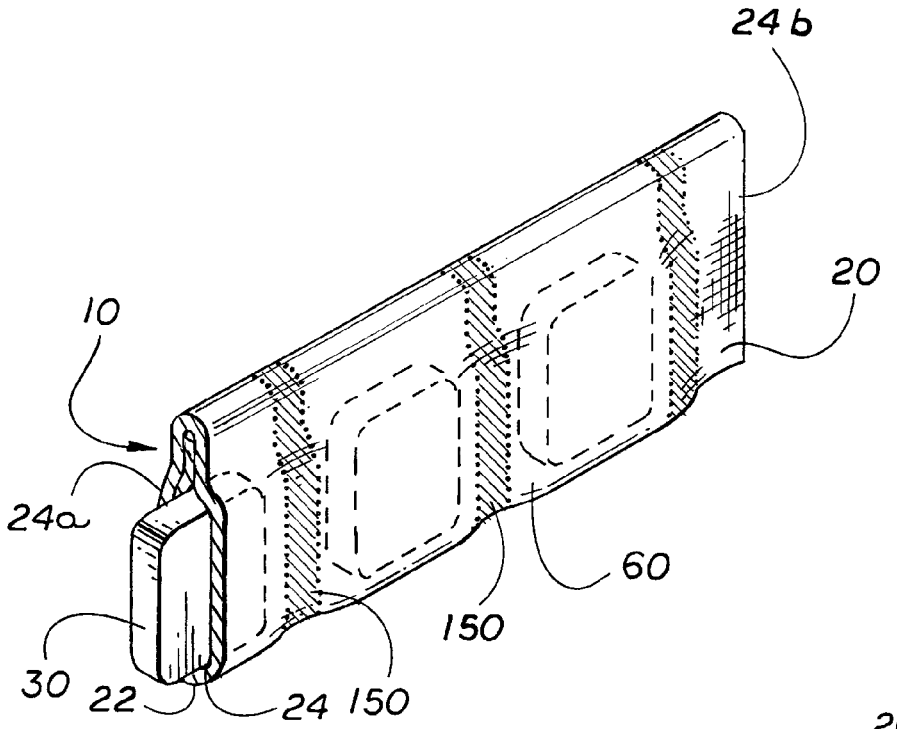
FIG. 13 depicts a portion of a weighted ribbon according to an alternate embodiment of the present invention, and shows a partial sectional view thereof.

In the alternate embodiments of FIGS. 11-13, 16, weighted ribbon 10 is formed by v-folding ribbon 20, along its length, to provide closed-end 22, and thus trough 24 for the receipt of uniformly dimensioned weights 30 therewithin. Advantageously in these embodiments, sufficient width of ribbon 20 is provided such that one or both of sides 24*a*, 24*b* of trough 24 may be reflexively folded over (i.e., along the longitudinal axis of weighted ribbon 10), such that one or both of top edges 24*c*, 24*d* of trough 24 resides adjacent side 24*a* (or side 24*b*) of trough 24, preferably proximate to closed-end 22. In this construction, continuous longitudinal seal 40 and discontinuous longitudinal seal 140 become unnecessary, inasmuch as transverse double seals 50 (or transverse broad-single-seals 150, as shown in FIG. 13) would provide sufficient bond strength to form an integral construction of each segment of weighted ribbon 10. With this construction, cutting between double seals 50 would provide a dumpling 60 of the general form depicted in FIG. 12. Similarly, cutting between broad-single-seals 150 would provide a dumpling 60 of the general form depicted in FIG. 16.

In a further alternate embodiment, ribbon 20 of the present invention may be fabricated to include use of a supplemental binding or sealing material or agent, in order to increase or enhance the strength of seals 40, 50, 150.

Generally, the several embodiments of weighted ribbon 10 of the present invention may be manufactured pursuant to the following method: providing ribbon 20 formed of a woven, fusible fabric; folding ribbon 20 along its longitudinal length to provide closed-end 22 and to thus define trough 24 having sides 24*a*, 24*b* and top edges 24*c*, 24*d*; providing a plurality of weights 30; disposing each weight 30 of the plurality of weights in spaced array within trough 24; closing trough 24 to maintain the plurality of weights 30 therewithin; and, forming, in ribbon 20, at least one transverse seal 50 or 150 between each weight 30 disposed within trough 24. The at least one transverse seal 50 or 150 provides for a digitally-defined section for transverse division of weighted ribbon 10 into discrete lengths (of either selected lengths of multi-weight ribbon 10 and/or individual weight dumplings 60), without loss of a weight 30 adjacent to a transverse division of the weighted ribbon 10, and without substantial fraying of ribbon 20 proximate a transverse division.

More specifically, the step of forming, in ribbon 20, at least one transverse seal comprises the step of forming, in ribbon 20, a transverse double seal 50 between each weight 30 disposed within trough 24, and wherein transverse double seal 50 comprises an unsealed region 52 therebetween, and wherein unsealed region 52 constitutes the digitally-defined section for transverse division of weighted ribbon 10 into discrete lengths. Alternatively, the step of forming, in ribbon 20, at least one transverse seal comprises the step of forming, in ribbon 20, a transverse broad-single-seal between each weight 30 disposed within trough 24, and wherein the transverse broad-single-seal constitutes the digitally-defined section for transverse division of weighted ribbon 10 into discrete lengths. In either instance, the at least one transverse seal 50 or 150 between each weight 30 extends from closed-end 22 substantially to top edges 24*c*, 24*d* of trough 24, and wherein the at least one transverse seal 50 or 150 between each weight 30 serves as a fray-reduction and/or a fray-stopping element upon transverse division of weighted ribbon 10.

The step of closing trough 24 comprises the step of forming either continuous longitudinal seal 40 or discontinuous longitudinal seal 140 proximate top edges 24*c*, 24*d* of trough 24. Alternatively, the step of closing trough 24 comprises the step of reflexively folding over at least one of sides 24*a*, 24*b* of trough 24 such that at least one of top edges 24*c*, 24*d* of trough 24 resides adjacent a side 24*a* or 24*b* of trough 24, preferably proximate closed-end 22.

Figure 25:
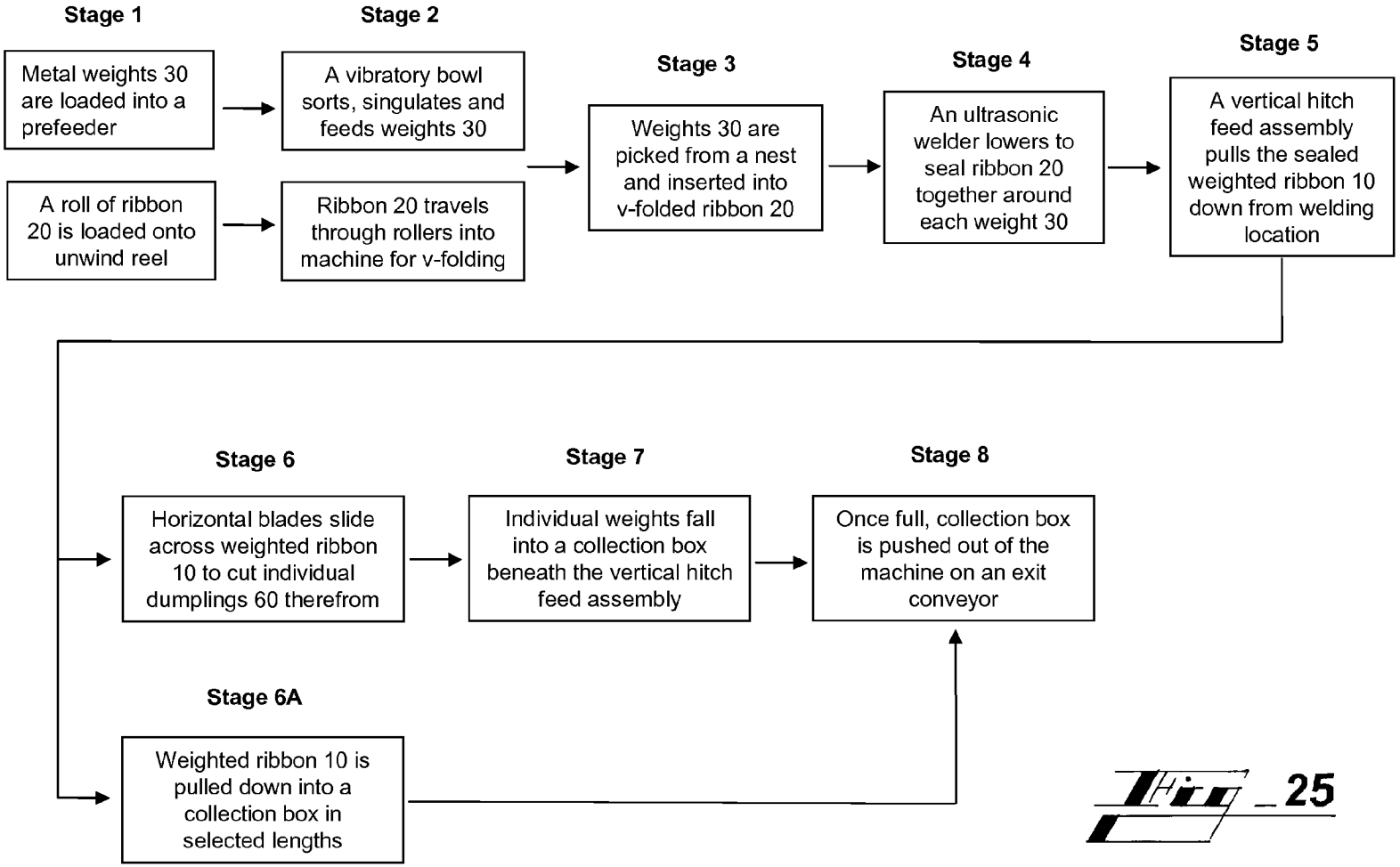

Referring now more specifically to FIG. 25, illustrated therein is a flow chart depicting the form and function a machine assembly that may be used to implement the methods of manufacture of the several embodiments of weighted ribbon 10 of the present invention. Accordingly, and with reference to the enumerated "Stages" set forth in FIG. 25, the form and function of such a machine assembly may be broadly described, as follows: Stage 1—metal weights 30 are loaded into a prefeeder, and a roll of ribbon 20 is loaded onto an unwind reel; Stage 2—a vibratory bowl sorts, singulates and feeds weights 30, and ribbon 20 travels through rollers into the machine for v-folding; Stage 3—weights 30 are picked from a nest and inserted into the v-folded ribbon 20; Stage 4—an ultrasonic welder lowers into position to seal ribbon 20 around each weight (i.e., to thus form "side" seals 50 or 150, and "top" seal 40 or 140/140*a*); Stage 5—a vertical hitch feed assembly pulls the sealed weighted ribbon 10 down from the welding location of Stage 4; Stage 6—horizontal blades slide across weighted ribbon 10 to cut individual weight dumplings 60 therefrom, or, in alternate Stage 6A, a predetermined length of weighted ribbon is pulled down into a collection box and subsequently cut; Stage 7—the individual weight dumplings 60 fall into a collection box beneath the hitch assembly; and, Stage 8—once full of either dumplings 60 or lengths of weighted ribbon 10, the collection box is pushed out of the machine onto an exit conveyor.

Still more specifically, with continued reference to FIG. 25, and with regard to Stage 1 and Stage 2, weights 30 are manually loaded into a prefeeder of any selected size or dimension (such as, for exemplary purposes, standard one cubic foot prefeeder), wherein the prefeeder meters out weights 30, on demand, into vibratory feeding bowl. The vibratory bowl sorts, singulates, and feeds weights 30, single file, into vibratory track for transfer to the pick and placing system of Stage 3. N roll of ribbon 20 is manually loaded onto an unwind reel, whereupon, as part of the initial threading process, a short length of ribbon 20 is dispensed, and then threaded through fold-over fingers, around a ribbon opening shoe, across the assembly deck of the machine, and then positioned inside of a vertical hitch feed assembly. A vertical hitch feed assembly is a mechanical device for advancing sheet and strip material (such as ribbon 20 hereof), and comprises a support assembly for reciprocating one of a pair of opposing transfer blocks relative to each other, and a release mechanism for use with each of the transfer blocks for facilitating the insertion and removal of the material (i.e., ribbon 20). Under normal operation, the vertical hitch feed assembly clamps onto ribbon 20 at its highest vertical position. Once clamped, the vertical hitch feed assembly lowers down to its lowest limit, and thus pulls ribbon 20 across the assembly deck of the machine and off of the unwind reel. The length of this stroke is selectable, but may be, for example, equal to three weight pockets along ribbon 20.

With continued reference to FIG. 25, and now with regard to Stage 3 and Stage 4, two axis pneumatic pick and place assembly, equipped with a three-up pitch changing vacuum end effector, is provided to remove weights 30 from the vibratory track, described above, and load them into a staging nest. With a backlog of weights 30 present on the vibratory track, the pick and place vertical axis lowers down from its home position to engage the weights 30. The end effector is in its closed. position, sharing the common center dimension of weights 30 as they are backlogged against each other. Once the end effector contacts weights 30 and vacuum is made, the pick and place retracts to its home position, removing weights 30 from the vibratory track. Subsequently, the horizontal axis extends, transferring weights 30 from their position over top of the vibratory track to a position over top of the staging nest. From this position, the vertical axis again lowers down positioning weights 30 in the nest. Vacuum is turned off and the vertical axis retracts back up, leaving weights 30 behind in the nest. The horizontal axis now retracts bringing the entire pick and place assembly back to its home position where the process is then repeated for the next three weights 30. Concurrent to the pick and place cycle, the next three weights 30 are delivered to the pick-off area by the vibratory track. The staging nest is positioned directly in front of the ribbon path at the welding area. With a group weights 30 present the staging nest and ribbon 20 indexed into position, weights 30 are pushed from the staging area and directly into the v-folded ribbon 20 via a pneumatically driven pusher. As the pusher retracts, leaving weights 30 positioned inside of v-folded ribbon 20, the ultrasonic welding unit (of Stage 4) immediately lowers down to capture weights 30 and create the individual weight segments 60 of weighted ribbon 10. Specifically, and with regard to Stage 4, a Branson Model 2000X ultrasonic welding assembly is provided to bond or seal together the v-folded ribbon 20 around each weight 30, to thus form "side" seals 50 or 150, and "top" seal 40 or 140/140*a*.

With continued reference to FIG. 25, and now with regard to Stage 5 and Stages 6, 6A, three pneumatically driven cutter assemblies are provided to facilitate the cutting of weighted ribbon 10 subsequent to the sealing process of Stage 4. Located at the vertical hitch feed assembly, the ribbon cutting assembly is mounted horizontally along the ribbon path. When the hitch feed pulls weighted ribbon 10 down and positioned in its fully extended position, the cutter assembly is activated. Accordingly, and in Stage 6, the three knife assemblies cut weighted ribbon 10 into individual weight dumplings 60, and wherein, subsequent to such cutting, these individual weight dumplings 60 drop into the collection box of Stage 7. Alternatively, at Stage 6A, a predetermined length of weighted ribbon 10 is manually entered through the use of an operator computer control panel. Once this predetermined length of weighted ribbon 10 is obtained, a cutter assembly is activated, separating the predetermined length of weighted ribbon 10 from the "feed" of weighted ribbon 10 leaving the vertical hitch feed assembly, weighted ribbon 10 is being dispensed by the vertical hitch feed assembly, and prior to the cutting process, the predetermined length of weighted ribbon 10 is laid into the collection box, accordion style. This is accomplished by moving the box underneath the predetermined length of weighted ribbon 10 as it is dispensing from the vertical hitch feed assembly.

With final reference to FIG. 25, and now with regard to Stage 7 and Stage 8, an AC motor driven, flat belt infeed conveyor is provided to accumulate and deliver erected boxes to their loading position, directly below the vertical hitch feed system. Boxes must be provided fully erect with the bottom flaps taped in their closed position. Upper flaps can remain vertical, providing they are not partially or fully bent over, blocking the box opening. Once manually loaded onto the infeed conveyor, boxes are transferred into the machine where they come to rest against a retractable end stop. On demand, end stop is retracted and a box is transferred onto a movable platform in the box loading position via a pneumatic pusher assembly. The movable platform comprised flat dead plate and programmable X-Y table. During the dispensing process of weighted ribbon 10 by the vertical hitch feed assembly, and when collecting predetermined lengths of weighted ribbon 10, the X-Y table moves in the appropriate directions to facilitate the accordion style loading of predetermined lengths of weighted ribbon 10 into the box. When collecting individual weight dumplings 60, the X-Y table remains in a stationary position below the vertical hitch feed assembly. Once a box has received the predetermined amount of weighted ribbon 10 or dumplings 60, the box is transferred from X-Y table onto a discharge conveyor via a box pneumatic pusher assembly. An AC motor driven, flat belt discharge conveyor is provided to accumulate and deliver filled boxes outside of the machine for operator collection.

It is contemplated herein that determinations of general size or dimension of weighted ribbon 10 and dumplings 60, together with the height, length and/or width of any of double seals 50, unsealed sections 52, broad-single seals 150, and/or longitudinal seals 40, 140, as well as the dimensions of weights 30, may be based upon the particular application in which weighted ribbon 10 and/or dumplings 60 are to be used, or upon the physical characteristics (e.g., thickness, weight, denier, etc.) of the particular fabric of ribbon 20, or upon the particular fabric or material of the curtain in which weighted ribbon 10 and/or dumplings 60 are to be used, or further upon a preferred manufacturing process. For example, and without limitation, ribbon 20 may be approximately 3.04 inches in width, such that v-folding ribbon 20 would provide trough 24 with sides 24*a*, 24*b* measuring approximately 1.45 inches in height and a closed end 22 measuring approximately 0.14 in width, such that weights 30, measuring approximately 1.00×1.00×0.08 inches (or even 1.00×1.00×0.11 inches) may be easily received within trough 24 and seated within closed end 22 of v-folded ribbon 20. Furthermore, in the foregoing example, each seal of double seals 50 may measure approximately 0.12-0.13 inches in width, with each unsealed section 52 disposed therebetween measuring approximately 0.0625-0.125 inches in width. Alternatively, in the foregoing example, each broad-single seal 150 may measure approximately 0.25 inches in width. Moreover, and continuing with the foregoing example, continuous longitudinal seal 40 or discontinuous longitudinal seal 140 (and more specifically short seals 140*a* thereof) may measure approximately 0.12-0.13 inches in width, with the lengths thereof determined by the overall length of weighted ribbon 10. Accordingly, in either the double seal 50 or broad-single seal 150 embodiments of the weighted ribbon 10 in the foregoing example, dumplings 60 cut therefrom would each have "side" seals measuring approximately 0.12-0.13 inches in width and a "top" seal measuring approximately 0.12-0.13 inches in width. In addition, and as previously stated, double seals 50 or broad-single seals 150 preferably extend from closed end 22 to top edges 24*c*, 24*d* of trough 24. Alternatively, double seals 50 or broad-single seals 150 may be formed so as to extend from closed end 22 and stop just short of top edges 24*c*, 24*d* of trough 24, or, further alternatively, may be formed so as to extend from top edges 24*c*, 24*d* of trough 24 and stop just short of closed end 22, or, yet further alternatively, may be formed so as to extend between, but stop just short of both, closed end 22 and top edges 24*c*, 24*d* of trough 24.

Applications for the weighting systems of the present invention, whether of ribbon or dumpling type, may include stage curtains, such as main curtains, valences, borders, legs, rear stage curtains, mid-stage curtains, lambrequins, tormentors, cycloramas, sharkstooth scrims, back-drops, bounce drops, Lenos, Kabuki curtains, masking curtains, and the like. Similarly, the weighting systems of the present invention may be used in association with plastic or vinyl sheeting for industrial applications. Additionally, the weighting systems of the present invention may be used in awnings, sails, shades, draperies, divider curtains, exhibit curtains, wraparound masking for tables and displays, trade show booth masking, cubicle curtains in hospitals and health care facilities, home theater curtains, casements, shears, black-out curtains, linings, and the like.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is:

1. A weighted ribbon, comprising:

a ribbon formed of a woven, fusible fabric, said ribbon having a fold along the length of said ribbon, wherein said fold forms a closed-end of said weighted ribbon, thereby forming a trough, said trough comprising sides and top edges;

a plurality of weights disposed in spaced array within said trough;

a longitudinal seal formed proximate to said top edges of said trough; and, a plurality of transverse seals formed in said weighted ribbon, wherein at least one transverse seal of said plurality of transverse seals is formed between each weight disposed within said trough, and wherein each transverse seal of said plurality of transverse seals comprises a section for cutting said weighted ribbon, wherein said weighted ribbon can be cut through any said section of any said transverse seal to separate from said weighted ribbon at least one selected length of multi-weight ribbon or at least one individual weight dumpling, and wherein any said cut through any said section of any said transverse seal can be made without loss of a weight adjacent to any said cut, and without substantial fraying of said ribbon proximate to any said cut.

2. The weighted ribbon of claim 1, wherein each said transverse seal of said plurality of transverse seals is a transverse double seal.

3. The weighted ribbon of claim 2, wherein each said transverse double seal comprises an unsealed region therebetween, and wherein each said unsealed region comprises a said section for cutting said weighted ribbon.

4. The weighted ribbon of claim 1, wherein each said transverse seal of said plurality of transverse seals is a transverse broad-single-seal.

5. The weighted ribbon of claim 4, wherein each said transverse broad-single-seal comprises a said section for cutting said weighted ribbon.

6. The weighted ribbon of claim 1, wherein each said one transverse seal of said plurality of transverse seals extends from said closed-end substantially to said top edges of said trough.

7. The weighted ribbon of claim 1, wherein each said transverse seal of said plurality of transverse seals serves as fray-reduction element upon cutting through any said section of any said transverse.

8. The weighted ribbon of claim 1, wherein each said transverse seal of said plurality of transverse seals serves as a fray-stopping element upon cutting through any said section of any said transverse seal.

9. The weighted ribbon of claim 1, wherein said longitudinal seal is a continuous longitudinal seal that extends through the length of said ribbon.

10. The weighted ribbon of claim 1, wherein said longitudinal seal is a continuous longitudinal seal that extends uninterrupted through the length of said ribbon, and intersects each said at least one transverse seal formed between each said weight of said plurality of weights disposed within said trough.

11. The weighted ribbon of claim 1, wherein said longitudinal seal is a discontinuous longitudinal seal that extends through the length of said ribbon.

12. The weighted ribbon of claim 1, wherein said longitudinal seal is a discontinuous longitudinal seal that extends through the length of said ribbon as a series of short seals formed at regular intervals, such that at least one short seal of said series of short seals is formed between each of a first said at least one transverse seal and each of a second said at least one transverse seal flanking each said weight of said plurality of weights disposed within said trough.

13. The weighted ribbon of claim 12, wherein each said at least one short seal of said series of short seals neither intersects each of said first and said second at least one transverse seals, nor is interposed or formed within any said section of each of said first and said second at least one transverse seals.

14. The weighted ribbon of claim 1, wherein said longitudinal seal, said plurality of transverse seals, and said closed end, maintain said plurality of weights within said weighted ribbon.

15. The weighted ribbon of claim 1, wherein any said at least one selected length of multi-weight ribbon or any said at least one individual weight dumpling so separated from said weighted ribbon is to be used in a curtain or other fabric member.

16. The weighted ribbon of claim 1, wherein said plurality of transverse seals and said longitudinal seal are formed utilizing a sealing process selected from the group consisting of ultrasonic sealing and heat sealing.

17. The weighted ribbon of claim 1, wherein said ribbon is imbued with flame retardant characteristics.

18. The weighted ribbon of claim 1, wherein each said weight of said plurality of weights is lead-free.

19. A method of producing a weighted device for use in a curtain or other fabric member, said method comprising the steps of:

providing a ribbon formed of a woven, fusible fabric;

folding said ribbon to form a closed end along the length of said ribbon, and to thereby form a trough, said trough comprising sides and top edges;

providing a plurality of weights;

disposing each weight of said plurality of weights in spaced array within said trough;

forming a longitudinal seal proximate to said top edges of said trough;

forming a plurality of transverse seals in said ribbon to provide a weighted ribbon wherein at least one transverse seal of said plurality of transverse seals is formed between each weight disposed within said trough, and wherein each transverse seal of said plurality of transverse seals comprises a section for cutting said weighted ribbon, wherein a cut can be made through any said section of any said transverse seal to separate from said weighted ribbon at least one selected length of multi-weight ribbon or at least one individual weight dumpling, and wherein any said cut through any said section of any said transverse seal can be made without loss of a weight adjacent to any said cut, and without substantial fraying of said ribbon proximate to any said cut; and, cutting through any said section of any said transverse seal to separate from said weighted ribbon said at least one selected length of multi-weight ribbon or said at least one individual weight dumpling, said at least one selected length of multi-weight ribbon or said at least one individual weight dumpling to be used in a curtain or other fabric member.

20. The method of claim 19, wherein each said transverse seal of said plurality of transverse seals is a transverse double seal.

21. The method of claim 20, wherein each said transverse double seal comprises an unsealed reason therebetween, and wherein each said unsealed region comprises a said section for cutting said weighted ribbon.

22. The method of claim 19, wherein each said transverse seal of said plurality of transverse seals is a transverse broad-single-seal.

23. The method of claim 22, wherein each said transverse broad-single-seal comprises a said section for cutting said weighted ribbon.

24. The method of claim 19, wherein each said transverse seal of said plurality of transverse seals extends from said closed-end substantially to said top edges of said trough.

25. The method of claim 19, wherein each said transverse seal of said plurality of transverse seals serves as a fray-reduction element upon cutting through any said section of any said transverse seal.

26. The method of claim 19, wherein each said transverse seal of said plurality of transverse seals serves as a fray-stopping element upon cutting through any said section of any said transverse seal.

27. The method of claim 19, wherein said longitudinal seal is a continuous longitudinal seal that extends through the length of said ribbon.

28. The method of claim 19, wherein said longitudinal seal is a continuous longitudinal seal that extends uninterrupted through the length of said ribbon, and intersects each said at least one transverse seal formed between each said weight of said plurality of weights disposed within said trough.

29. The method of claim 19, wherein said longitudinal seal is a discontinuous longitudinal seal that extends through the length of said ribbon.

30. The method of claim 19, wherein said longitudinal seal is a discontinuous longitudinal seal that extends through the length of said ribbon as a series of short seals formed at regular intervals, such that an least one short seal of said series of short seals is formed between each of a first said at least one transverse seal and each of a second said at least one transverse seal flanking each said weight of said plurality of weights disposed within said trough.

31. The method of claim 30, wherein each said at least one short seal of said series of short seals neither intersects each of said first and said second at least one transverse seals, nor is interposed or formed within any said section of each of said first and said second at least one transverse seals.

32. The method of claim 19, wherein said ribbon is imbued with flame retardant characteristics.

33. The method of claim 19, wherein each said weight of said plurality of weights is lead-free.

34. The method of claim 19, wherein said longitudinal seal and said plurality of transverse seals are formed utilizing a sealing process selected from the group consisting of ultrasonic sealing and heat sealing.

* * * * *